US005092052A

United States Patent [19]

Godsey

[11] Patent Number: 5,092,052

[45] Date of Patent: Mar. 3, 1992

[54] ADJUSTABLE BOW SIGHT

[76] Inventor: Samuel W. Godsey, 408 Park St., Plymouth, Wis. 53073

[21] Appl. No.: 558,168

[22] Filed: Jul. 25, 1990

[51] Int. Cl.[5] ..... F41G 1/467

[52] U.S. Cl. ..... 33/265; 124/87; 33/248

[58] Field of Search ..... 33/265, 260, 257, 254, 33/248, 247; 124/87, 86

[56] References Cited

U.S. PATENT DOCUMENTS

| | | | |
|---|---|---|---|
| 2,267,692 | 2/1954 | Leafstrand | 33/265 |
| 2,642,661 | 6/1953 | Fredrickson | 33/265 |
| 3,013,336 | 12/1961 | Pennington | 33/265 |
| 3,318,298 | 5/1967 | Bear | 33/265 |
| 4,109,390 | 8/1978 | Smith et al. | 33/265 |
| 4,473,959 | 10/1984 | Salzman | 33/265 |
| 4,497,116 | 6/1985 | Hawkins | 33/265 |
| 4,541,179 | 9/1985 | Closson | 33/265 |
| 4,567,668 | 2/1986 | King et al. | 33/265 |
| 4,977,677 | 12/1990 | Troescher, Jr. | 33/265 |
| 4,986,001 | 1/1991 | Giamattei | 33/265 |

*Primary Examiner*—William A. Cuchlinski, Jr.
*Assistant Examiner*—William C. Dowling
*Attorney, Agent, or Firm*—Andrus, Sceales, Starke & Sawall

[57] ABSTRACT

An adjustable bow sight includes a unique forward sight element mounting and adjusting mechanism by which the sight is moved in a generally vertical linear path in response to rotary movement of a signal adjustment arm. A slotted pivotal attachment between the sight mounting plate and the forward end of the sight adjustment arm translates rotary movement of the latter into purely linear movement of the sight element. The substantially simpified construction and operation of the adjustable sight provides all of the benefits of prior art constructions utilizing complex quadrilateral linkage adjustment mechanisms.

5 Claims, 2 Drawing Sheets

ADJUSTABLE BOW SIGHT

BACKGROUND OF THE INVENTION

The present invention relates to a sight for an archery bow and, more particularly, to a sight of relatively simple construction and operation which is adjustable for varying sight distances.

The prior art is replete with bow sights which are adjustable to cause the sight element to move vertically with changes in the target distance to alter the trajectory of the arrow. In many of these adjustable sights, a distance scale indicator allows the archer to move a distance indicator to coincide with the estimated target distance. Movement of the indicator automatically moves the sight element so that the bow will be appropriately tilted to provide the necessary trajectory. A number of prior art device utilize a quadrilateral or four-leg linkage to which both the distance pointer and sight element are attached The legs of the quadrilateral linkage, which may include portions of the mounting structure, are generally of unequal lengths such that incremental movement of the distance indicator will be translated through the linkage and result in some other incremental movement of the sight element. Adjustable sights of this type are shown, for example, in U.S. Pat. Nos. 4,418,479; 4,497,116; and 4,541,179. A similar sight construction, but one not having a distance indicator, is shown in U.S. Pat. No. 4,109,390.

Sights utilizing a quadrilateral linkage to impart complimentary movement to the distance indicator and sight element are generally of two types. In one type, equal incremental movements of the sight distance indicator toward increasing target distance positions causes progressively greater incremental movements of the sight element. This type of arrangement is shown in previously identified U.S. Pat. Nos. 4,418,479 and 4,541,179. In the quadrilateral sight adjustment linkage in U.S. Pat. No. 4,497,116, progressively increasing incremental movements of the sight distance pointer result in proportionally greater incremental movements of the sight element as well. A similar movement of the sight occurs in the device shown in U.S. Pat. No. 4,109,390, although as indicated previously, the trigger mechanism does not include a distance indicator. All of the foregoing patents, however, recognize the principle that with equal incremental increases in the target distance, the arrow must be tilted through progressively increasing vertical angles to provide the necessary increase in trajectory to compensate for the increasing effect of gravity on the flight of the arrow. In a somewhat more simple adjustable sight construction, U.S. Pat. No. 2,667,692 discloses a device which provides a sight indicator that compensates both for the necessary progressive increase in the vertical angle and for varying bow strengths.

Those prior art devices which utilize quadrilateral linkages to interconnect the distance indicator and sight element are characterized by their complex constructions, including a large number of parts and four or more separate pivotal connections. It has been found, however, that such complex arrangements by which certain incremental movements of the sight distance indicator result in some type of proportional incremental movement of the sight element do not accommodate the use of a standard preset scale for distance indication. Rather, depending on the type and strength of the bow and possibly other factors, archers ordinarily use a "shoot and try" method of sight calibration in which the yard markers are set by a simple process of repeated shooting at incremental distances (e.g. 10 yards), marking the distance scale at the position of the distance indicator when on target, repeating the procedure at increasing 10 yard increments from the target, and applying the incremental distance marks to the distance scale. In other words, the distance indications on the bow sight distance scale are usually uniquely positioned for each bow and for the archer using it. Another problem exhibited by bow sights with pivotal multi-leg linkages is the tendency of the sight to be thrown off the set sight distance as a result of the "kick" caused by the arrow as it is released.

Somewhat simpler adjustable bow sight constructions are shown in U.S. Pat. Nos. 2,642,661 and 3,318,298 in each of which the sight element slides in a generally vertically disposed track to provide adjustment corresponding to varying target distances. In both of these sights, incremental movement of the sight along the distance indicator results in directly equal movement of the sight element.

Although the prior art sights identified above have performed adequately, there is a need for a simplified construction which will provide the same basic operation and is easy to adjust and use. The sight should also be of rugged construction and adaptable for use on wide ranges of bow types.

SUMMARY OF THE INVENTION

In accordance with the present invention, there is provided an improved adjustable bow sight of relatively simple construction which operates in a manner similar to prior art devices utilizing a quadrilateral linkage, but is not encumbered by a complex four-leg linkage arrangement.

The sight includes a base plate which is mounted on one side of the bow in a generally vertical plane parallel to the line of sight and opposite the side of the bow which includes the arrow cradle. A sight adjustment arm includes a central pivotal attachment by which it is mounted to the base plate for pivotal movement in the vertical plane. A sight mounting plate is slidably attached to the forward edge of the base plate and comprises complimentary interconnected linear tracks on the forward edge of the base plate and the rear edge of the mounting plate, which tracks defines a generally vertical path for movement of the sight mounting plate. One end of the sight adjustment arm extends forwardly beyond the slidable attachment and includes a slotted pivotal attachment to the mounting plate which allows the mounting plate to slide vertically in the tracks with respect to the base plate in response to rotation of the adjustment arm on its central pivotal attachment. The rear edge of the base plate includes a semicircular distance scale which defines an arc centered on the central pivotal attachment of the arm to the base plate. The opposite end of the adjustment arm extends rearwardly to the distance scale and includes a distance indicator positioned to travel along the distance scale in response to rotation of the adjustment arm. A sight element is attached to the sight mounting plate in a manner to extend horizontally past the front of the bow to the side opposite the mounting of the base plate such that the sight element is disposed generally above the arrow cradle.

The sight element is preferably demountably attached to the mounting plate and includes means for adjustably positioning the sight element vertically along the forward edge of the mounting plate and laterally with respect to the vertical plane in which the adjustment arm and sight mounting plate move. The slotted pivotal attachment between the forward end of the sight adjustment arm and the sight mounting plate includes an elongate slot in the mounting plate which is disposed with its long axis generally horizontal. A pivot pin is attached to the end of the adjustment arm and extends into the slot and includes a follower mounted on the end of the pin for sliding movement in the slot in response to rotation of the adjustment arm and movement of the mounting plate in its vertical path. The elongate slot in the mounting plate includes a peripheral recess, and the follower comprises a bushing having a cylindrical body positioned in the slot and a flanged end positioned in the peripheral recess to maintain more precise alignment between the adjustment arm and the mounting plate.

The opposite rearward end of the adjustment arm and the upper and lower ends of the semicircular distance scale include non-slip surface portions which allow the end of the arm and one end of the scale to be easily grasped between thumb and forefinger for quick and easy adjustment of the sight distance indicator.

DETAILED DESCRIPTION OF THE PREFERRED EMBODIMENT

Figure 1:
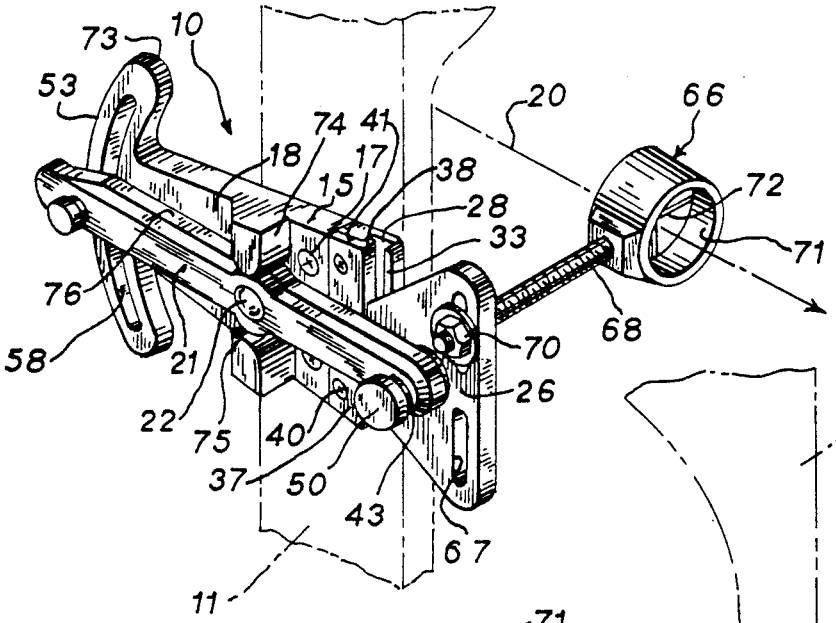
FIG. 1 is a perspective view of the adjustable bow sight of the present invention shown mounted on one side of a bow.
Figure 2:
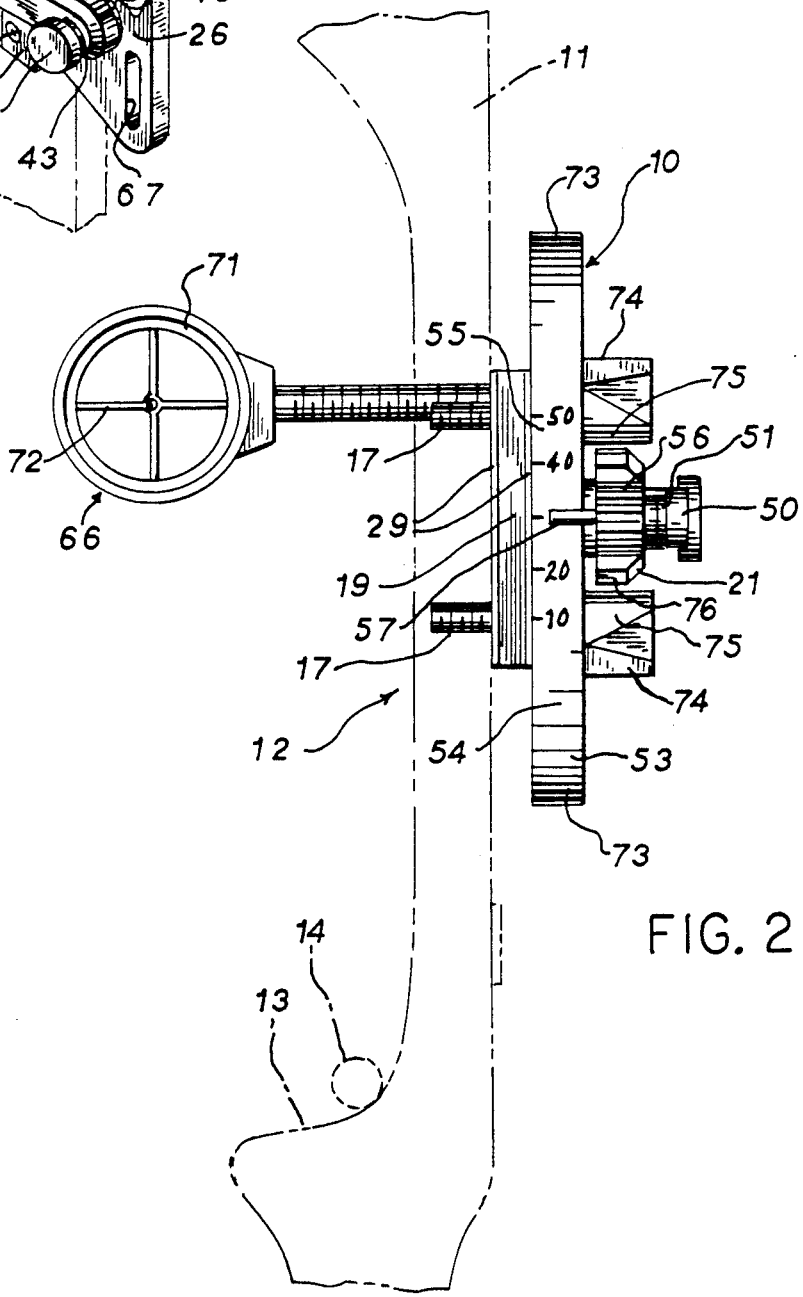
FIG. 2 is a rear view of the adjustable sight shown in FIG. 1 looking in the direction of the target.

Referring initially to FIGS. 1 and 2, an adjustable bow sight 10 of the present invention is adapted to be attached to an archery bow 11 on the side opposite the bow sight window 12 and above the cradle 13 for the arrow 14. As is conventional in bow construction, the sight window 12 is located just above the handle or hand grip (not shown).

The sight includes a base plate 15 by which the sight 10 is attached to the bow 11. The base plate 15 includes a pair of vertically spaced mounting holes 16 through which suitable threaded fasteners, such as flat head machine screws 17 may be inserted and threaded into suitably tapped holes in the bow 11. In actual construction utilizing a wooden bow handle, tapped metal grommets (not shown) would be inserted into the bow handle for receipt of the mounting screws 17. The base plate has a generally flat outer surface 18 which defines a generally vertical plane parallel to the line of sight 20 shown in FIG. 1. Because the side faces of some bows are not completely flat, it may be desirable to place a spacer block 19 between the bow and the base plate 15, and to place a flexible gasket 29 on one or both sides of the spacer block, all as shown in FIG. 2.

Figure 3:
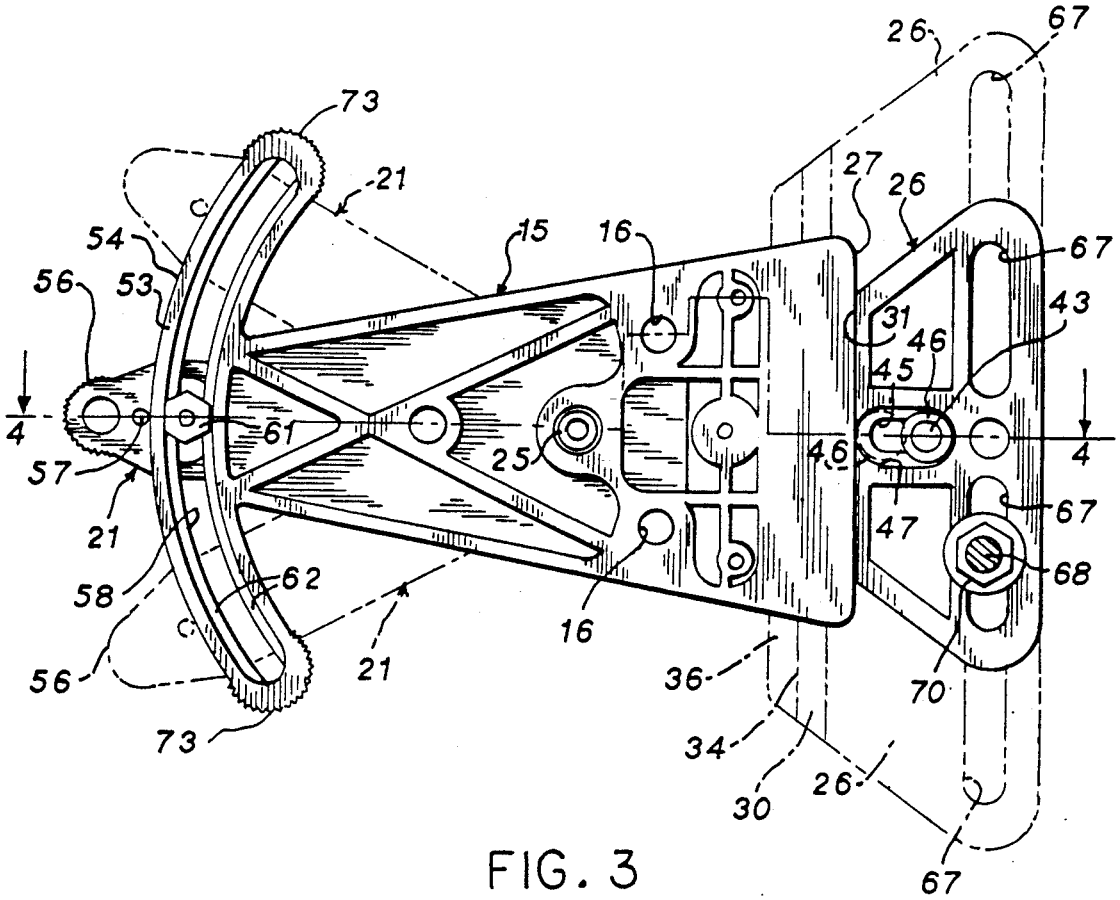
FIG. 3 is a side elevation of the bow sight taken from the backside to show details of the construction.
Figure 4:
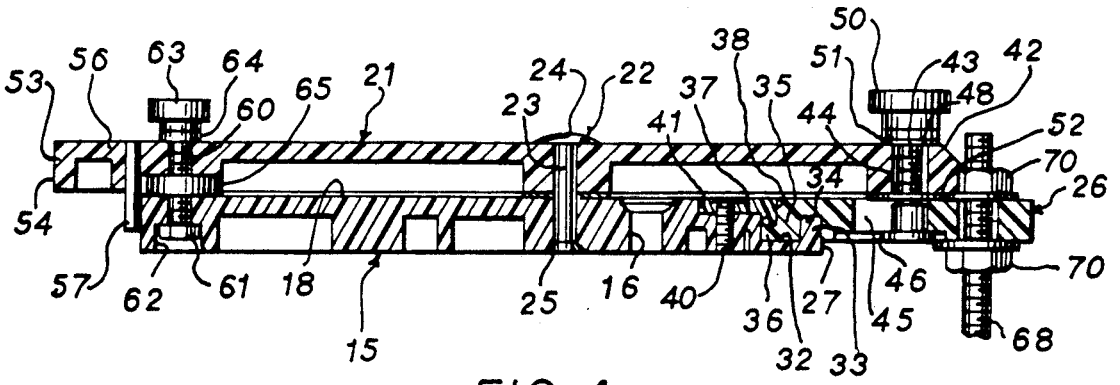
FIG. 4 is a horizontal section through the bow sight taken on line 4—4 of FIG. 3.

A sight adjustment arm 21 is pivotally mounted to the base plate 15 by a centrally disposed pivotal attachment 22. Referring also to FIGS. 3 and 4, the pivotal attachment 22 between the sight adjustment arm 21 and the base plate 15 may conveniently comprise a rivet 23 having its head end 24 in engagement with the outer surface of the adjustment arm 21 and an opposite flared end 25 secured to the inner face of the base plate 15.

A sight mounting plate 26 is slidably attached to the forward edge 27 of the base plate 15 so that the mounting plate 26 may be moved in a generally vertical path with respect to the mounting plate 15 and bow 11. The slidable attachment between the sight mounting plate and the base plate comprises complimentary engaging linear tracks. One linear track 28 is formed in the forward edge 27 of the base plate 15 and the other complimentary linear track 30 is formed in the rear edge 31 of the sight mounting plate 26. The base plate track 28 includes a vertically extending linear groove 32 bounded at the forward edge 27 by a lip 33. Similarly, the mounting plate linear track 30 includes a vertically extending linear groove 34 bounded at its rear edge 31 by a lip 35. Sliding engagement between the complimentary linear tracks 28 and 30 is provided by receipt in the base plate groove 32 of the mounting plate lip 30 and receipt in the mounting plate groove 34 of the base plate lip 33. In addition, the edge of the base plate lip 35 is provided with an integral auxiliary lip 36 coextensive therewith and disposed at a right angle thereto. A retaining plate 37 is attached, as with a pair of mounting screws 40, to the base plate 15 just to the rear of the base plate groove 32. The retaining plate 37 includes a retaining lip 38 which extends into the groove 28 in closely spaced relation to the mounting plate lip 35 and integral auxiliary lip 36. This retains the complimentary linear tracks 28 and 30 in engagement and restricts the sight mounting plated 26 to purely linear vertical movement along the forward edge 27 of the base plate 15. The retaining plate 37 is set in a longitudinal recess 41 in the forward edge of the base plate 15 so that the outer surface of the retaining plate is flush with the flat outer surface 18 of the base plate.

The forward end 42 of the sight adjustment arm 21 extends past the forward edge 27 of the base plate 15 to overlie a portion of the sight mounting plate 26 where it is pivotally attached thereto with a pivot pin 43. The pivot pin 43 includes an internally threaded bushing 44 secured in the forward end 42 of the adjustment arm 21 and extending beyond the lower surface of the arm into an elongate slot 45 in the sight mounting plate 26. The bushing 44 rotates slightly within the elongate slot 45 as the sight adjustment arm 21 is pivoted about its central pivotal attachment 22 and the sight mounting plate 26 is carried therewith along the linear track. However, because the linear movement of the sight mounting plate 26 in its linear track along the forward edge of the base plate 15 causes the mounting plate 26 to move away from the circular arc within which the pivot pin 43 travels as the arm 21 is moved from its centered full line position shown in FIG. 3 either upwardly or downwardly to the dotted line positions, the bushing 44 also acts as a follower and slides in the elongate slot 45 to the rear dotted line position when the sight adjustment arm 21 is in either its upper most or lower most position. To retain the bushing 44 in the slot 45, the end of the bushing is provided with a thin flange 46 which sits in a peripheral recess 47 surrounding the slot 45. A set screw 48 is threaded into the threaded interior of the bushing 44 and is provided with an enlarged head 50, whereby the set screw 48 may be turned into the bushing 44 to slightly clamp the adjustment arm 21 against the sight mounting plate 26 to selectively vary the amount of force required to adjust the sight. A first resilient washer 51 may be disposed between the set screw head 50 and the surface of the arm 21 and a second resilient washer 52 may be disposed around the cylindrical body of the bushing 44 between the opposed surfaces of the arm and the mounting plate 26. The resilient washers help hold the components in set position when the set screw 48 is threaded into the bushing 44.

The rear edge of the base plate 15 is provided with an integral semicircular distance scale 53 which defines an arc concentric with the central pivotal attachment 22 of the adjustment arm 21 to the base plate 15. The distance scale 53 includes a semicylindrical rear face 54 which is provided with a set of indicia 55 indicative of varying sight distances and usually calibrated in yards. The sight adjustment arm 21 extends rearwardly beyond the distance scale 53 where it terminates in a ribbed end 56. A horizontally disposed distance indicator 57 is attached to the end 56 of the arm 21 in a position where it rides along closely spaced from the semicylindrical rear face 54 of the distance scale 53. In this manner, as the sight adjustment arm 21 is caused to pivot about its attachment to the base plate 15, the distance indicator 57 will move along the scale 53. To help retain accurate positioning between the distance indicator 57 and the distance scale 53, the end of the sight adjustment arm 21 is attached to ride along a semicircular slot 58 in the distance scale which is also concentric with a central pivotal attachment 22. A threaded guide screw 60 extends through a hole in the arm 21 just forward of the distance indicator 57, through the semicircular slot 58, and into threaded engagement with a nut 61 which is captured in a pair of semicircular recesses 62 on opposite sides of the slot 58. The nut 61 rides in the recesses 62 along the semicircular slot 58 as the adjustment arm 21 is pivoted. A small resilient washer 64 is disposed between the head 63 of the guide screw 60 and a large resilient washer 65 is disposed between the opposed surfaces of the adjustment arm and the base plate so the frictional engagement and thus the relative sliding movement between them may be varied as desired. The screw 60 may also be used to set the sight at a selected sight distance by appropriately tightening it after the position is established.

A sight element 66 is attached to the forward edge of the sight mounting plate 26 in a manner to extend across the forward edge of the bow 11 into a position generally within the sight window 12 and above the arrow 14 and arrow cradle 13. The forward edge of the sight mounting plate 26 is provided with a pair of vertically extending and vertically spaced sight mounting slots 67. The sight element 66 is attached to a mounting bolt 68 which, in turn, may be adjustably attached to one of the sight mounting slots 67 as with oppositely disposed nut and washer pairs 70. In this manner, the sight element may be varied both laterally and vertically over substantial distances to accommodate a wide variety of bow constructions and sight mounting positions. The sight element 66 includes a hollow cylindrical shroud 71 which supports a centrally mounted cross hair 72. The shroud and cross hair may be of molded plastic construction, as are the other major components of the sight, except for the various metal fasteners.

The upper and lower ends of the distance scale 53 at the rearward end of the base plate 15 are provided with ribbed surfaces 73 similar to the ribbed end 56 of the sight adjustment arm 21. By grasping the ribbed end 56 and one of the ribbed surfaces 73 between the thumb and forefinger, the archer may easily rotate the sight adjustment arm 21 upwardly or downwardly toward or away from either of the remote positions shown in phantom in FIG. 3. Referring also to FIG. 2 and, in particular, to the distance indicia 55 on the distance scale 53, movement of the sight adjustment arm 21 and attached distance indicator 57 downwardly toward a lower distance indication will result in upward movement of the sight mounting plate and attached sight element 66. As the sight is raised and the archer moves the bow to maintain the cross hair 72 on target, the bow and arrow will be tilted downwardly in the vertical plane through the line of sight 20. Correspondingly, upward movement of the distance indicator 57 along the distance scale 53 in an upward direction to an increased target distance indication causes downward movement of the sight mounting plate and attached sight element 66. To maintain the sight on target, the bow and arrow will be tilted upwardly in the vertical plane through the line of sight 20 such that the proper projectory will be imparted to the arrow when it is released. As indicated previously, because of wide variations in the construction and strength of bows, the distance indicia 55 are preferably attached through the use of a trial and error method in which an appropriate number of arrows are shot at each incremental sight distance until the sight is determined to be on target at each incremental distance. The separate indicia 55 are then applied to correspond to the position of the distance indicator 57 at the appropriate distance.

The flat outer surface 18 of the base plate 15 is provided with a pair of vertically spaced bosses 74 located on opposite sides of the central pivotal attachment 22. The bosses 74 are provided with integral rearwardly extending abutment surfaces 75 which diverge from one another. As the sight adjustment arm 21 is moved upwardly or downwardly toward either of its most extreme positions, the corresponding upper or lower lateral surface portion 76 of the adjustment arm will contact one of the abutment surfaces 75 to provide a positive stop against further rotation. In this manner, the guide screw 60 and associated nut 61 moving along the semicircular slot 58 in the distance scale 53 do not have to be relied upon to restrict movement of the sight mechanism beyond its maximum limits. It should also be noted that the adjustable sight of the present invention is completely symmetrical with respect to the horizontal axis of the sight adjustment arm 21. In this manner, the sight may be mounted and utilized on the opposite side of a bow designed for left handed archers. Also, as is best seen in FIGS. 3 and 4, the undersides of the base plate 15, sight adjustment arm 21, and sight mounting plate 26 employ ribbed constructions to reduce the weight of the assembly and to save material.

The adjustable bow sight 10 of the present invention provides all of the benefits of the various prior art devices utilizing complex quadrilateral linkages, yet is of substantially simpler design and has a robust construction particularly well suited to the outdoor hunting environment.

Various modes of carrying out the present invention are contemplated as being within the scope of the following claims particularly pointing out and distinctly claiming the subject matter which is regarded as the invention.

I claim:

1. An adjustable sight for an archery bow comprising:

a base plate adapted to be mounted on one side of the bow in a generally vertical plane parallel to the line of sight;

a sight adjustment arm having a central pivotal attachment to said base plate for pivotal movement in said vertical plane;

a sight mounting plate having a slidable attachment to the forward edge of the base plate;

said slidable attachment including complimentary engaging linear tracks on the forward edge of said base plate and the rear edge of said mounting plate, said tracks defining a generally vertical path of movement for said sight mounting plate;

the forward end of said adjustment arm having a slotted pivotal attachment to said mounting plate forward of said linear tracks adapted to cause said mounting plate to slide vertically with respect to said base plate in response to rotation of said adjustment arm on said central pivotal attachment;

a semicircular distance scale attached to the rear edge of said base plate and defining an arc concentric with said central pivotal attachment;

the opposite rearward end of said adjustment arm extending rearwardly to said distance scale and having a distance indicator attached thereto for travel along said distance scale in response to rotation of said adjustment; and, a sight element attached to said sight mounting plate.

2. The invention as set forth in claim 1 wherein said sight element is demountably attached to said mounting plate and further including adjustment means for adjustably positioning said element vertically along said mounting plate and laterally with respect to said vertical plane.

3. The invention as set forth in claim 1 wherein said slotted pivotal attachment comprises:

an elongate slot in said mounting plate having a generally horizontal long axis;

a pivot pin attached to said forward end of the adjustment arm and extending into said elongate slot; and, a follower attached to said pivot pin for sliding movement in said slot in response to rotation of said adjustment arm and movement of said mounting plate in said vertical path.

4. The invention as set forth in claim 3 wherein said elongate slot includes a circumferential peripheral recess and said follower comprises a bushing having a cylindrical body disposed in said slot and a flanged end disposed in said peripheral recess.

5. The invention as set forth in claim 1 including non-slip surface portions on the opposite end of said adjustment arm and on the upper and lower ends of said semicircular adjustment scale to enhance finger engagement therewith for sight adjustment.

* * * * *